US011179595B2

(12) United States Patent
Chaudhuri

(10) Patent No.: US 11,179,595 B2
(45) **Date of Patent: *Nov. 23, 2021**

(54) RESISTANCE TRAINING SYSTEM

(71) Applicant: Raja Chaudhuri, Aliso Viejo, CA (US)

(72) Inventor: Raja Chaudhuri, Aliso Viejo, CA (US)

( * ) Notice: Subject to any disclaimer, the term of this patent is extended or adjusted under 35 U.S.C. 154(b) by 24 days.

This patent is subject to a terminal disclaimer.

(21) Appl. No.: 16/786,171

(22) Filed: Feb. 10, 2020

(65) Prior Publication Data

US 2020/0171341 A1 Jun. 4, 2020

Related U.S. Application Data

(63) Continuation of application No. 15/986,681, filed on May 22, 2018, now Pat. No. 10,556,145.

(51) Int. Cl.
*A63B 21/00* (2006.01)
*A63B 23/035* (2006.01)
(Continued)

(52) U.S. Cl.
CPC ..... *A63B 21/156* (2013.01); *A63B 21/00185* (2013.01); *A63B 21/16* (2013.01); *A63B 21/28* (2013.01); *A63B 21/4034* (2015.10); *A63B 21/4035* (2015.10); *A63B 23/03525* (2013.01); *A63B 23/03533* (2013.01); *A63B 23/03575* (2013.01); *A63B 23/0488* (2013.01); *A63B 23/1209* (2013.01); *A63B 23/1263* (2013.01)

(58) Field of Classification Search
CPC ..... A63B 21/156; A63B 23/03525; A63B 23/1263; A63B 21/28; A63B 21/00185; A63B 23/1209; A63B 21/4034; A63B 21/4035; A63B 23/03533; A63B 23/03575; A63B 23/0488; A63B 21/16; A63B 21/1609; A63B 21/1663; A63B 23/0355; A63B 23/03508; A63B 21/15; A63B 21/151; A63B 21/154; A63B 21/4001–4021; A63B 2023/006
See application file for complete search history.

(56) References Cited

U.S. PATENT DOCUMENTS 195,116 A * 9/1877 Foster ..... A63B 21/068 482/95
546,568 A 9/1895 Whitely
(Continued)

FOREIGN PATENT DOCUMENTS

DE 4107065 9/1992

OTHER PUBLICATIONS

International Search Report and Written Opinion from IA No. PCT/US2019/026660 dated Jul. 1, 2019.
(Continued)

*Primary Examiner* — Megan Anderson
*Assistant Examiner* — Kathleen M Fisk
(74) *Attorney, Agent, or Firm* — Crockett & Crockett, PC; K. David Crockett, Esq.

(57) ABSTRACT

A resistance training system includes a tackle providing mechanical advantage, and a user performs strength training exercises by pulling or pushing on the running block while resisting motion of the running block by pulling or pushing on the free end of the runner. The running block, fixed block and free end of the system may be secured at various locations of the body.

3 Claims, 8 Drawing Sheets

(51) Int. Cl.

| | |
|---|---|
| ***A63B 23/12*** | (2006.01) |
| ***A63B 21/28*** | (2006.01) |
| ***A63B 23/04*** | (2006.01) |
| ***A63B 21/16*** | (2006.01) |

(56) References Cited

U.S. PATENT DOCUMENTS 1,374,697 A 4/1921 Werndli
2,183,265 A 12/1939 Maloney
2,938,695 A * 5/1960 Ciampa ..... A63B 21/1645 248/214
3,858,874 A 1/1975 Weider
3,937,461 A * 2/1976 Lew ..... A63B 7/02 482/43
3,979,114 A 9/1976 Codina
4,060,240 A 11/1977 Dunston
4,290,598 A * 9/1981 Flannery ..... A63B 21/06 482/94
4,531,514 A * 7/1985 McDonald ..... A61H 1/0218 482/144
4,826,155 A * 5/1989 James ..... A63B 21/00181 482/104
4,828,253 A * 5/1989 Schicketanz ..... A63B 21/154 482/906
4,974,836 A 12/1990 Hirsch
5,067,709 A 11/1991 Christianson
5,253,639 A * 10/1993 Johnston ..... A63B 23/03575 482/131
5,403,253 A * 4/1995 Gaylord ..... A63B 21/068 482/140
5,795,274 A 8/1998 Kasbohm
6,110,083 A * 8/2000 Riser ..... A63B 21/154 482/142
6,113,564 A * 9/2000 McGuire ..... A61H 1/0229 482/131
8,192,337 B2 6/2012 Birch et al.
8,376,919 B2 * 2/2013 Eddy ..... A63B 21/154 482/131
9,630,043 B2 4/2017 Foster
9,821,188 B2 * 11/2017 Dwork ..... A63B 7/02
2010/0227744 A1 9/2010 Dang
2011/0034307 A1 2/2011 Eddy
2013/0267392 A1 * 10/2013 Miranda ..... A63B 21/06 482/102
2014/0296044 A1 * 10/2014 Kucharski ..... A63B 21/00185 482/131
2016/0045778 A1 2/2016 Dwork et al.
2018/0311526 A1 11/2018 Eddy

OTHER PUBLICATIONS

Letter from Shireen R. Marshall, Ph.D., J.D., Elevated IP, LLC to David Crockett, Esq., Crockett & Crockett, PC (Sep. 17, 2021).

* cited by examiner

RESISTANCE TRAINING SYSTEM

This application is a continuation of U.S. application Ser. No. 15/986,681, filed May 22, 2018, now U.S. Pat. No. 10,556,145.

FIELD OF THE INVENTIONS

The inventions described below relate to the field of resistance training.

BACKGROUND OF THE INVENTIONS

Weight training systems such as free weights, weight machines, and resistance bands are useful for increasing strength, but have limitations. The limitations arise from the fact that the amount of weight that can be lifted by a person varies greatly over the range of motion of the involved limb. For example, when performing a bicep curl, the amount of weight-lifting force the bicep can exert is small at the start of exercise, when the arm is fully extended. The amount of weight-lifting force the bicep can exert when lifting a weight (concentric motion) is large when the elbow is bent about 90°, and decreases greatly as the biceps nears complete contraction and the elbow is bent to its fullest extent. Also, the amount of force the bicep can exert when lowering a weight (eccentric motion) is larger than the amount of weight lifting force that the bicep can exert. However, free weights and weight machines apply a single level of resistance over the entire range of motion of the limb, and apply the same level of resistance in both concentric and eccentric motion of the limb. When using a weight machine, a user must limit the amount of weight to be lifted to that weight which can be lifted when the arm is fully extended, and this is lower than the amount of weight the biceps can lift when bent at a 90° angle. The user cannot increase the resistance of the system for eccentric motion. Some weight lifting machines can increase the amount of resistance applied during lifting, but they cannot adjust the amount of resistance applied when the user is lowering a weight. Thus, when using a weight machine or free weights, a user cannot fully recruit and challenge the biceps during a biceps curl. Band resistance systems that rely on large rubber bands suffer the same problem, and also suffer from the additional problem that, as the bands are stretched, the resistance rises, so that the strength of the bands must be limited to that which can be lifted near the end of a curl, when the elbow is bent to its maximum extent (and to a weak position) while the band is stretched to its maximum extent, and the muscles cannot be exercised to the fullest extent possible. This leaves the entire movement up to that point under stimulated. As with weights and weight machines, eccentric phase is also under stimulated.

SUMMARY

The devices and methods described below provide for a resistance training system which can apply a consistent or variable amount of resistance over the full range of motion of a limb engaged in the resistance training exercise. The amount of resistance offered by the system can be constantly adjusted by the user to offer the optimal amount of resistance through the full range of motion. The system is a simple and compact system of cables and pulleys, and comprises a tackle, which includes a pair of pulley blocks and a runner (a cable, rope or belt) running through the pulley blocks. One pulley block is a fixed block, secured to a block connection for attaching the block to a convenient fixation point, and the other pulley block is a running block which moves according to manipulation of the cable, with a block connection for holding the running block to the user. The runner includes a first end and a second end, and the first end is a free end (sometimes referred to as a fall line or hauling part), which may be held and pulled by a user, and the second end is the fixed end, fixed to the fixed block (sometimes referred to as a standing part). The remainder of the runner runs in falls between the blocks (sometimes referred to as running parts), and runs over the pulleys of each block. The tackle (the block and pulley system) is configured to provide mechanical advantage, which may be provided in various ratios. The blocks may be straight blocks, fiddle blocks or other suitable blocks. The system may be used in several methods of exercise described below. Generally, a user will secure the fixed block to a fixation point (using a strap or stirrup, for example), and secure the moving block to the user's body (using a grip bar, for example), and hold the free end of the runner. While resisting movement of the free end, the user will push or pull on the running block. Due to the mechanical advantage of the system, the user may exert little effort to provide resistance while exerting intense effort to move the running block. The user may be assisted by a trainer, with the trainer holding the free end of the runner, and resisting movement of the free end with little exertion while the user exerts significant force to move the running block. The user or trainer controls the amount of exertion required of the exercising limb by adjusting the resistance applied to the free end by the controlling or "non-exercising" limb.

DETAILED DESCRIPTION OF THE INVENTIONS

Figure 1:
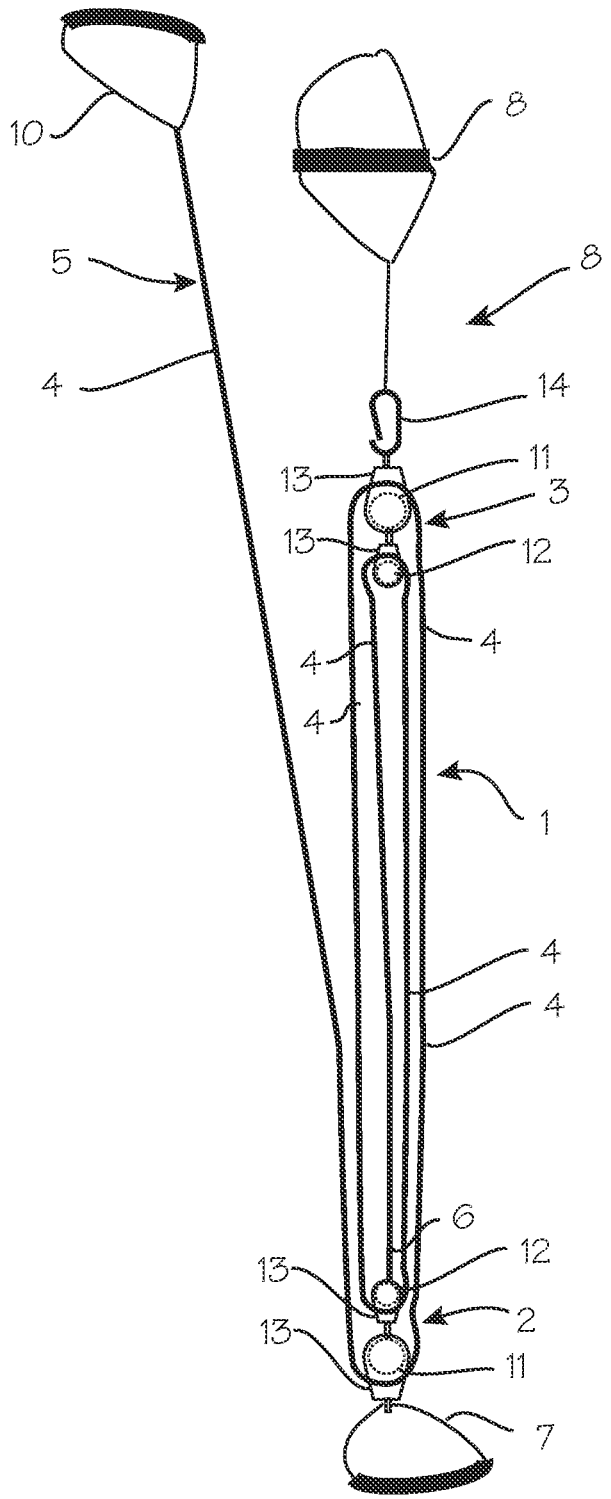
FIG. 1 illustrates the resistance training system.

FIG. 1 illustrates the resistance training system, which includes a tackle 1. The tackle is an arrangement consisting of runner and pulley block(s), which comprises a fixed pulley block 2, a running pulley block 3, and a runner (a rope, cable or belt) 4 with a free end 5 which may be grasped by a user or a trainer, and a fixed end 6 which is fixed to the fixed block 2. The fixed block is secured to, or integrally formed with, a fixed block connection 7. The running block is secured to, or integrally formed with, a running block connection 8. The fixed block connection 7 is configured to secure the fixed block to any stationary point, and may be configured as a strap that may be secured to a post, a block that may be trapped between a door and door jamb, or a stirrup or foothold that may be held down by the user's foot. The running block connection 8 is configured to secure the running block to the user, and may be configured as a hand grip 9 for grasping by the user, or as a stirrup that may be engaged by the user's foot, a belt that may be fastened around the user's waist or torso, a harness that may be fastened over the shoulders, torso or elsewhere, all depending on the resistance exercise to be performed using the system. The free end may also be provided with the grasping loop 10, or any other convenient handle.

The blocks may be single blocks, double blocks or triple blocks, with sheaves arranged coaxially, or they may be fiddle blocks or other blocks, and the runner may be threaded through the blocks to create a gun tackle with a 2 to 1 advantage, a luff tackle with a 3 to 1 advantage, a double tackle with a 4 to 1 advantage, a gyn tackle with a 5 to 1 advantage, or a threefold purchase with a 6 to 1 advantage. The tackle illustrated in FIG. 1 is a double tackle which provides a 4 to 1 advantage, which provides a good balance of mechanical advantage and relative throw of the free end to accommodate many exercises. The blocks illustrated in FIG. 1 are fiddle blocks, with large outer sheaves 11 and smaller inner sheaves 12 rotatably fixed within a shell (or shells) 13. Preferably, the sheaves are arranged with the circular cross sections lying in the same plane, or parallel planes, and may be rotationally fixed relative to each other so that one cannot rotate out of the common plane, or separate shells of the outer sheave and inner sheave may be lashed together to allow for slight rotation of the inner and outer sheaves relative to each other. The block connections can include carabiners 14 or other means for releasable attachment to the blocks, such as straps with hook and loop fasteners or snaps, fasters, or knotted ropes. The block connections may also include belts, hook and loop fasteners, carabiners or other means for releasable attachment to a fixation point. The same means for releasable fixation may be used for both purposes.

The system may be used in several methods of exercise described below. Generally, a user will secure the fixed block to a fixation point (using a strap, stirrup, carabiner, or hook, for example), and secure the running block to the user's body (using a strap, grip bar, stirrup or harness, for example), and hold the free end of the cable. While resisting movement of the free end, the user will push or pull on the running block. Due to the mechanical advantage of the system, the user may exert little effort to provide resistance while exerting intense effort to move the running block. The user may be assisted by a trainer, with the trainer holding the free end of the runner, and resisting movement of the free end with little exertion while the user exerts significant force to move the running block. The user or trainer can manipulate the free end, with the control limb or other body part, to provide resistance to require a desired amount of exertion by the exercising limb. Resistance can be increased during the concentric phase (from the start of a movement to the point at which the involved muscles are strongest) and decreased during the concentric movement (from the point at which the involved muscles are strongest to the end of the concentric movement) to match the capability of the involved muscles. The resistance can be increased during the eccentric movement, above the resistance provided in the concentric phase, to fully load the involved muscles during the eccentric movement. Various methods of use are illustrated in the following figures.

Figure 2A:
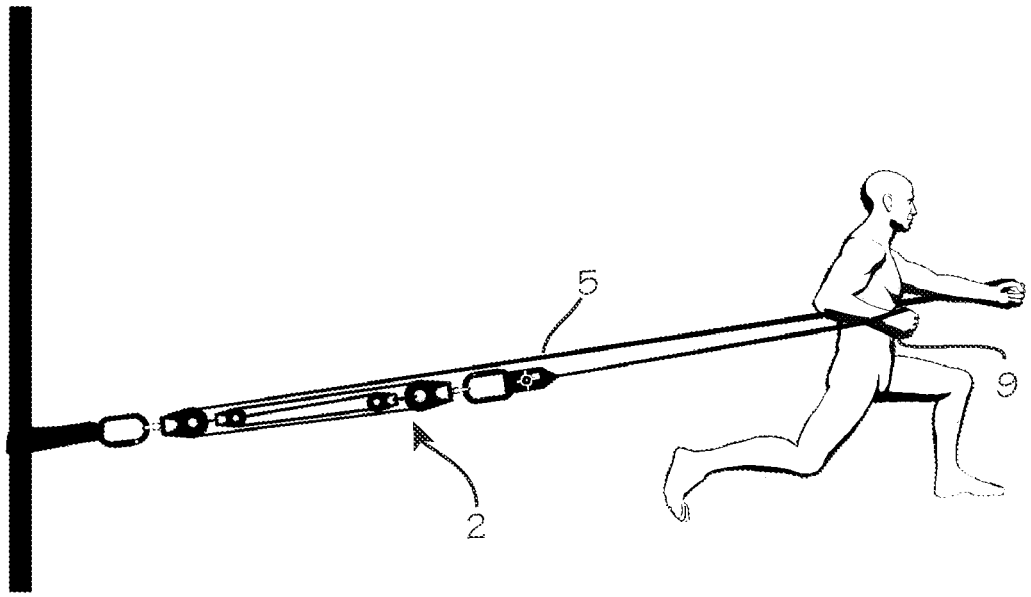
FIGS. 2A and 2B illustrate use of the system in an unassisted resistance training exercise such as a single arm chest press.
Figure 2B:
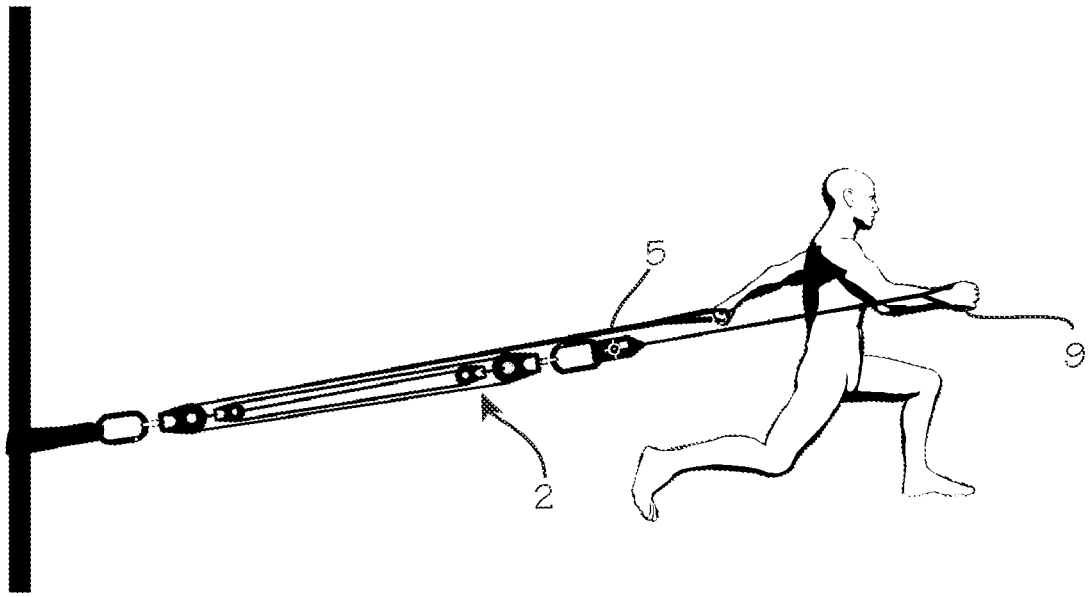

FIGS. 2A and 2B illustrate use of the system in an unassisted resistance training exercise such as single arm chest press. For this exercise, the fixed block 2 is fixed to an available fixed object such as a post, doorknob, etc., and the user holds the free end 5 in a non-exercising hand, and holds the running block connection (the hand grip 9) in the exercising hand. To accomplish this resistance training exercise, as shown in FIG. 2A, the user pushes the running block connection with the exercising arm and hand, pushing in the anterior direction of the body, while resisting movement of the free end 5 with the non-exercising side. The non-exercising arm and shoulder will need to extend and/or horizontally extend, while the user flexes and/or horizontally flexes the shoulder while extending the elbow of the exercising arm to perform a chest press motion. This accomplishes the concentric phase of the shoulder press exercise. As shown in FIG. 2B, to perform the eccentric phase of the shoulder press exercise, the user will pull forward (in the anterior direction relative to the body) on the free end with the non-exercising arm, and resist posterior movement of the running block, pushing anteriorly while slowly allowing posterior movement of the running block, extending and/or horizontally extending the shoulder and flexing the elbow of the exercising arm while resisting this movement. The non-exercising arm will need to exert little effort, while the exercising arm will need to exert a multiple of that effort, which is effective for strength training of the exercising side.

Figure 3A:
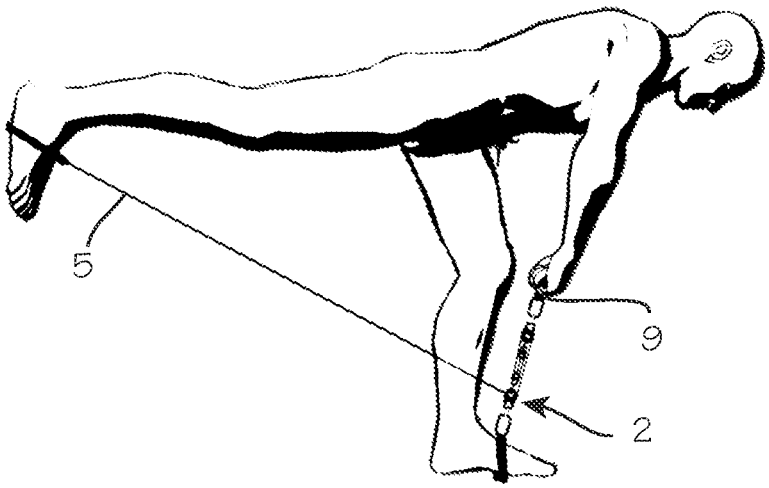
FIGS. 3A and 3B illustrate use of the system in an unassisted resistance training exercise such as a single arm deadlift.
Figure 3B:
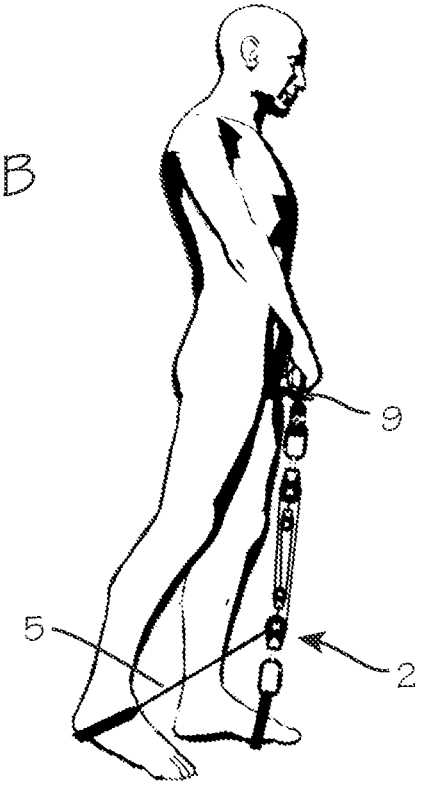

FIGS. 3A and 3B illustrate use of the system in an unassisted resistance training exercise such as single arm deadlift. For this exercise, the fixed block 2 is secured to the user's foot through a stirrup, trapped under the user's foot in the exercising side, and the user holds the free end 5 in the leg on the non-exercising side, and holds the running block connection (the hand grip 9) in the exercising arm. To accomplish this resistance training exercise, as shown in FIG. 3A, the user pulls the running block connection with either arm and hand (or both), and simultaneously extending and rotating the hips, using the gluteal muscles, hamstrings and posterior chain of the back on the exercising side, while resisting movement of the free end 5 with the leg of the non-exercising side (in this exercise, the free end is secured to the non-exercising side, and the running block is secured to the hand of the exercising side, or the non-exercising side, or both, and the leg of the exercising side is used to anchor the fixed block). The leg of the exercising side will need to resist forward rotation, while the user pulls upward on the running block and rotates the hip of the exercising side, including contracting the gluteal muscles and back muscles of the exercising side, and engaging the hamstrings, and contracting the gastrocnemius soleus muscle, to extend the leg and hip to achieve a full standing posture. This accomplishes the concentric phase of the dead lift. As shown in FIG. 3B, to perform the eccentric phase of the dead lift, the user will pull (in the posterior direction relative to the body) on the free end with the non-exercising leg, and resist anterior movement of the running block, pulling posteriorly while slowly allowing anterior (and downward) movement of the running block, exercising the gluteal muscles, hamstrings, and gastrocnemius muscles in reverse of the lifting movement, and rotating the hip forward to return to the position of FIG. 3A. The leg used for resistance (on the non-exercising side) will need to exert little effort, while the exercising hip will need to exert a multiple of that effort, which is effective for strength training of the exercising side.

Figure 4A:
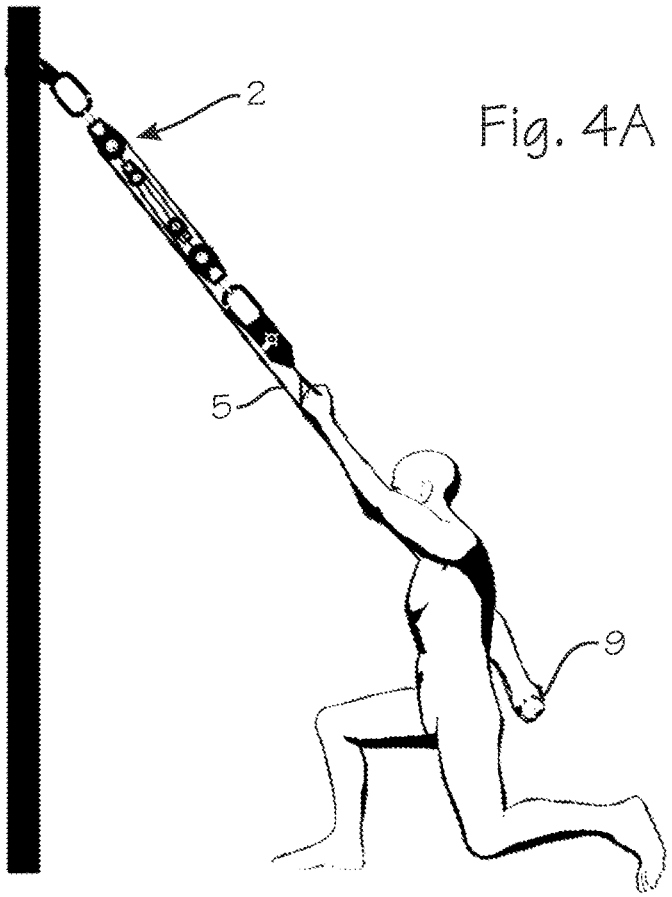
FIGS. 4A and 4B illustrate use of the system in an unassisted resistance training exercise such as a single arm lat pull.
Figure 4B:
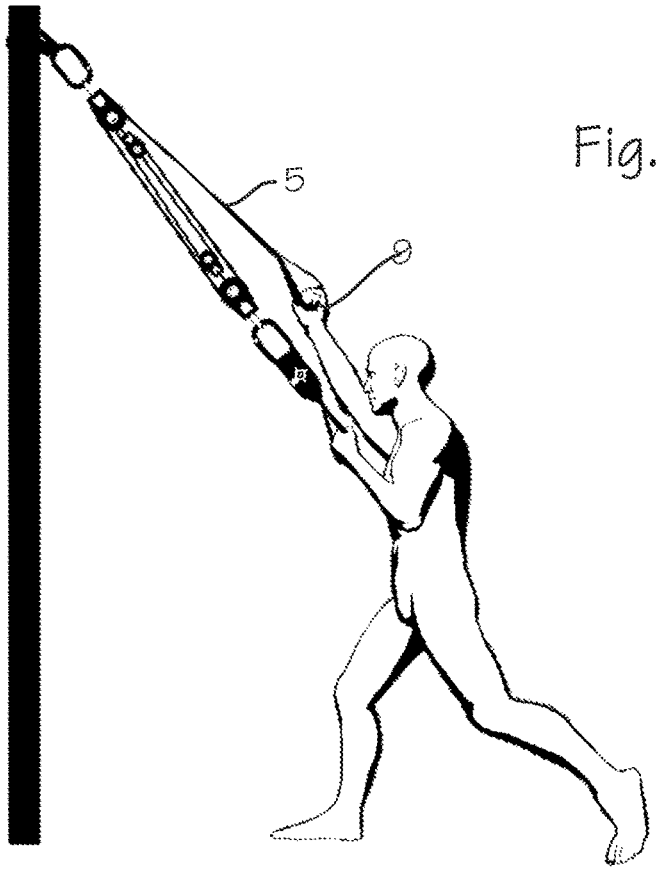

FIGS. 4A and 4B illustrate use of the system in an unassisted resistance training exercise such as single arm lat pull. For this exercise, the fixed block 2 is fixed to an available fixed object such as a post, doorknob, etc., above shoulder level of the user, and the user holds the free end 5 in a non-exercising hand, and holds the running block connection (the hand grip 9) in the exercising hand. To accomplish this resistance training exercise, as shown in FIG. 4A, the user pulls the running block connection with the exercising arm and hand, pulling in the inferior direction of the body, while resisting movement of the free end 5 with the non-exercising side (and allowing the free end to move toward the fixed block and allowing for movement of the exercising side). The non-exercising hand will need to resist upward movement, flexing the shoulder forward to move toward the fixed block, while the user engages the shoulder muscles (the deltoid muscle, for example) and contracts the biceps and latissimus muscles of the exercising side, to extend/adduct the shoulder and flex the elbow of the exercising arm, while flexing/abducting the shoulder and extending the elbow of the non-exercising arm to perform a lat pull motion. This accomplishes the concentric phase of the lat pull exercise. As shown in FIG. 4B, to perform the eccentric phase of the lat pull exercise, the user will pull downward (in the inferior direction relative to the body) on the free end with the non-exercising arm, and resist upward (superior) movement of the running block, pulling inferiorly while slowly allowing superior movement of the running block, superiorly abducting the shoulder and extending the elbow and latissimus muscles of the exercising arm while resisting this movement. The non-exercising arm will need to exert little effort, while the exercising arm will need to exert a multiple of that effort, which is effective for strength training of the exercising side.

Figure 5A:
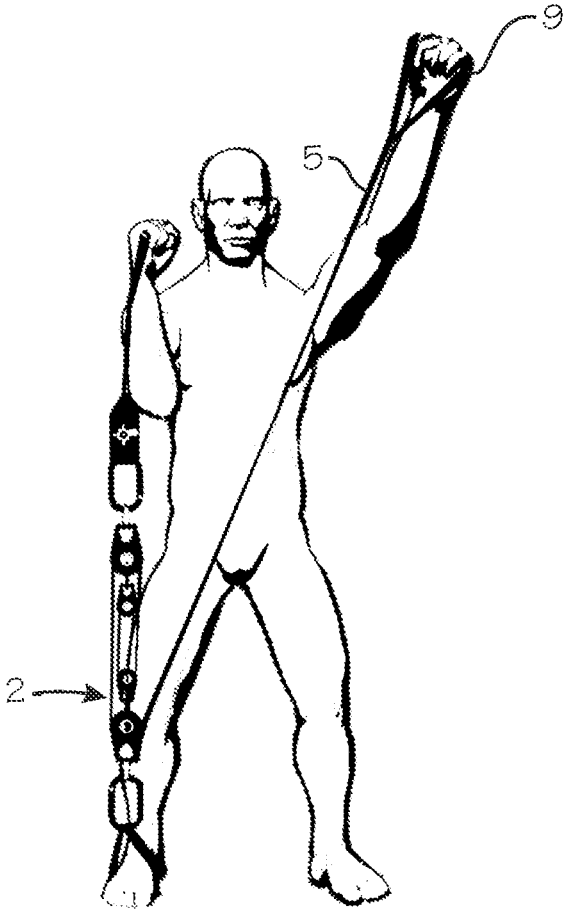
FIGS. 5A and 5B illustrate use of the system in an unassisted resistance training exercise such as a single arm military lift.
Figure 5B:
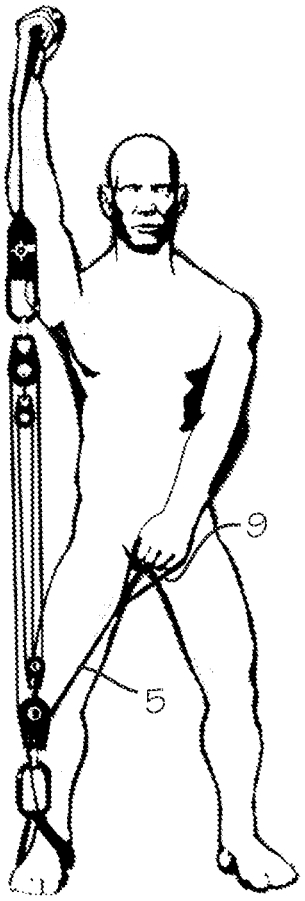

FIGS. 5A and 5B illustrate use of the system in an unassisted resistance training exercise such as single arm military lift. For this exercise, the fixed block 2 is secured to the user's foot through a stirrup, trapped under the user's foot on the exercising side (or the non-exercising side), and the user holds the free end 5 in the hand on the non-exercising side, and holds the running block connection (the hand grip 9) in the exercising hand. To accomplish this resistance training exercise, as shown in FIG. 5A, the user pushes upward on the running block connection (the hand grip 9) with the exercising arm and hand, pushing in the superior direction of the body, while resisting movement of the free end 5 with the arm of the exercising side. The arm of the non-exercising side will need to resist forward inferior movement, allowing the free end to move toward the fixed block, while the user pushes upward to perform a military press, and abducting the shoulder (contracting in a frontal plane) and extending the elbow of the exercising arm to perform a military lift motion. This accomplishes the concentric phase of the military lift. As shown in FIG. 5B, to perform the eccentric phase of the military press, the user will pull (in the superior direction relative to the body) on the free end with the non-exercising arm, and resist inferior movement of the running block, pulling superiorly while slowly allowing inferior (downward) movement of the running block, adducting the shoulder and flexing the elbow of the exercising arm while resisting this movement. The arm used for resistance (on the non-exercising side) will need to exert little effort, while the exercising arm will need to exert a multiple of that effort, which is effective for strength training of the exercising side.

Figure 6A:
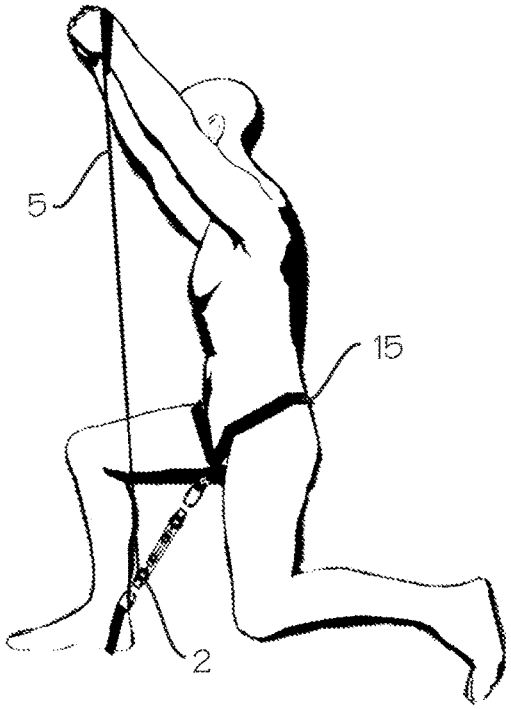
FIGS. 6A and 6B illustrate use of the system in an unassisted resistance training exercise such as a single leg press, using a harness secured about the waist to secure the running block to the user's body.
Figure 6B:
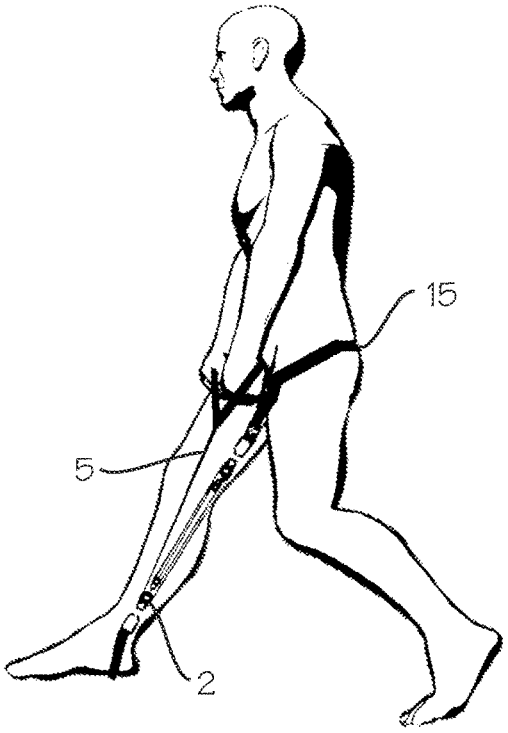

FIGS. 6A and 6B illustrate use of the system in an unassisted resistance training exercise such as single leg press, using a harness secured about the waist to secure the running block to the user's body. For this exercise, the fixed block 2 is secured to the user's foot through a stirrup, trapped under the user's foot in the exercising side, and the user holds the free end 5 in one or both hands, and secures the running block connection (a belt 15 or a harness) around the waist. To accomplish this resistance training exercise, as shown in FIG. 6A, the user pulls upward on the running block connection (the belt 15) with the exercising leg, pushing in the superior direction of the body (upward), exercising the quadriceps, gluteals and hamstrings, while resisting movement of the free end 5 with the arms and allowing the free side to move towards the fixed block. The arms will need to resist downward/inferior movement, while the user pushes the body upward to perform a leg press, and extend the hip and knee (contracting the quadriceps muscles) to lift the body to perform a leg press motion. This accomplishes the concentric phase of the leg press. As shown in FIG. 6B, to perform the eccentric phase of the leg press, the user will pull (in the superior direction relative to the body) on the free end with the arm(s), and resist inferior movement of the running block, pushing upwardly/superiorly with the leg while slowly allowing inferior (downward) movement of the running block, constantly engaging the quadriceps and flexing the hip and knee of the exercising leg while resisting this movement. The arms used for resistance will need to exert little effort, while the exercising leg will need to exert a multiple of that effort, which is effective for strength training of the exercising side.

Figure 7:
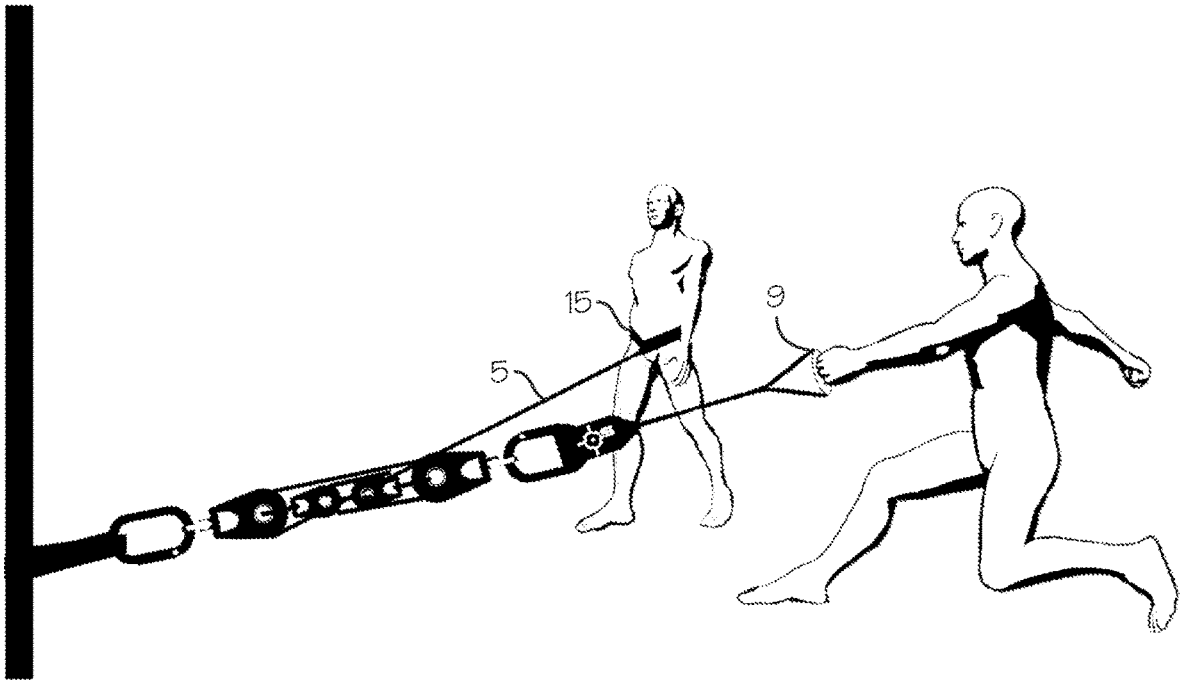
FIG. 7 illustrates use of the system in an assisted resistance training exercise such as single arm row, using a harness secured about the waist of a trainer to provide resistance while the user performs a single arm row.

FIG. 7 illustrates use of the system in an assisted resistance training exercise such as single arm row, using a belt 15 (or a harness) secured about the waist of a trainer to provide resistance while the user performs a single arm row. To accomplish this resistance training exercise, as shown in FIG. 7, the user pulls posteriorly on the running block connection (the hand grip 9) with the exercising arm, pulling in the posterior direction of the body (slightly upward), while the trainer resists movement of the free end 5, moving as necessary to maintain tension on the system. The trainer will need to resist posterior movement of the user's arm, while the user pulls the running block posteriorly to perform a single arm row motion. This accomplishes the concentric phase of the single arm row. To perform the eccentric phase of the single arm row motion, the trainer will pull on the free end, and the user will resist anterior movement of the running block, pulling posteriorly while allowing anterior movement of the running block, while resisting this movement. The trainer providing resistance will need to exert little effort, while the user will need to exert a multiple of that effort, which is effective for strength training of the exercising side.

The system can also be used in a method as described above wherein the free end is secured to an arm of the user (a first extremity) and the running block is secured to the torso of the user.

In each exercise, the user may grasp the running block directly through an integral running block connection, and dispense with a distinct running block connection such as the carabiner and hand grip.

Figure 8:
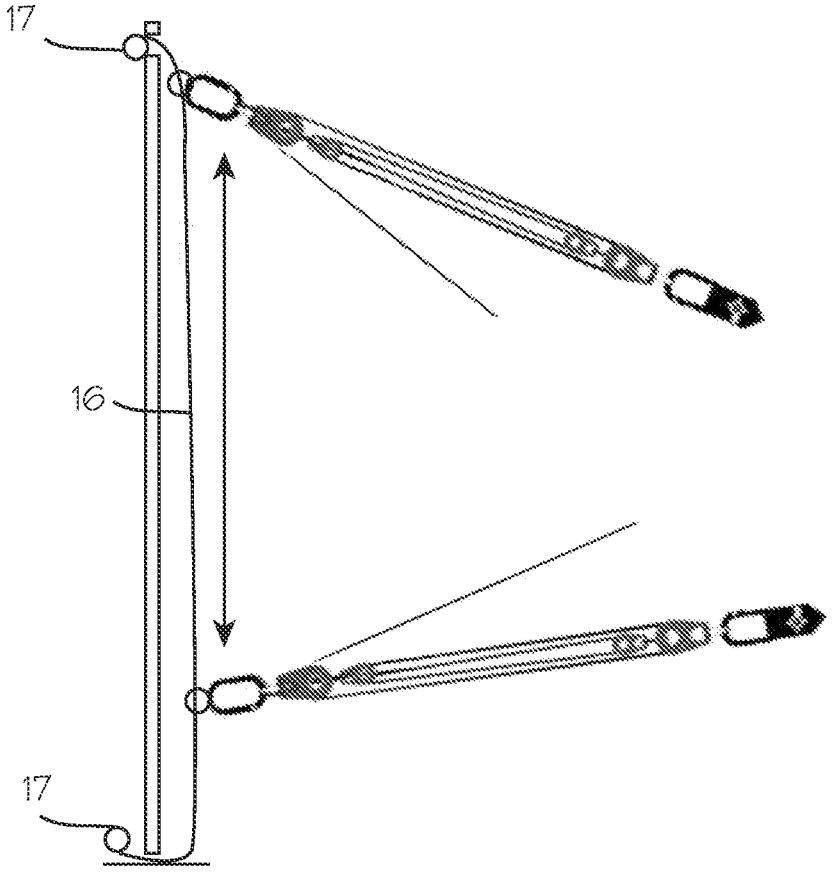
FIG. 8 illustrates the system with fixed block connection suitable for conveniently fixing the fixed block to a doorway.

FIG. 8 illustrates the system with fixed block connection suitable for conveniently fixing the fixed block to a doorway. The fixed block 2 is fixed to a fixed block connection 7 which may be a small hook and loop fastener, a carabiner, or other releasable fastening means, which may be releasably attached to a strap or bar 16. Blocks 17 are secured to the ends of the strap 16, such that the ends of the strap may be disposed between the door and the door jamb, with the blocks on one side of the door and the major length of the strap on the other side of the door. The fixed block connection can be attached to the strap at various heights, to create configurations corresponding to the configurations shown in FIGS. 4A and 7. The fixed block connection can be secured to the strap or bar 16 with any suitable adjustable attachment means, such as a carabiner combined with grommeted holes in the strap, or a prusik knot or other sliding hitch.

As illustrated in the Figures, the method of a performing resistance training exercises comprises providing a resistance training system having a tackle with a fixed block and a running block and a runner with a free end and a fixed end, with the free end configured to be secured to the body of the user, and the fixed end of the runner secured to the fixed block, and a running block connection configured to be secured to the body of a user, wherein the tackle is configured to provide mechanical advantage, and using this arrangement by securing the fixed block in a fixed position, securing the running block connection (which may be integral with the running block) to the body of user in a first location, using the user's body to move the running block (pushing or pulling it away from the fixed block) while keeping the fixed block stationary, while the user or a trainer resists movement of the free end in response to movement of the running block. The free end may be secured to the body of the user in a second location, while the user uses the body to resist movement of the free end, or the free end may be secured to the body of a trainer who holds and pulls the free end to resist movement of the free end while the user pushes or pulls the running block. Because the effort needed to provide effective resistance is quite low, the free end may be held in various points of the body, and many angles and movements can be used to manipulate the exercising limb. The user, or the trainer, may resist movement of the free end with a variable force, to vary the force necessary to move the running block, and thereby match the load on the involved muscles to their ability throughout the movement of each exercise, and adjust the resistance applied in the concentric and eccentric movements of each exercise. Preferably, the user or trainer will apply a higher level of resistance or load at the mid-point of a concentric movement than at the start or finish of a concentric exercise, and apply a higher level of resistance or load during the eccentric movement than during the concentric movement of each exercise.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A method of a performing resistance training exercise comprising a single leg press, where a user has a body including a waist, a leg and foot, and an arm and hand, said method comprising:

providing a resistance training system comprising:

a tackle having a fixed block, a running block, and a runner with a free end and a fixed end, said free end configured to be secured to the user's body, said fixed end secured to the fixed block, a running block connection configured to be secured to the user's body, wherein the tackle is configured to provide mechanical advantage;

securing the fixed block in a fixed position;

securing the running block connection to the user's waist; securing the free end to the user's arm or hand;

pushing the body upward to perform the single leg press, and extend a hip and knee of the leg, contracting the quadriceps muscles, to lift the user's body to perform a concentric phase of the single leg press while, with the user's arm or hand, resisting movement of the free end.

2. The method of claim 1 further comprising:

performing an eccentric phase of the singe leg press, by pulling, in a superior direction relative to the user's body, on the free end with the user's arm or hand, to resist inferior movement of the running block, pushing superiorly with the leg to allow inferior movement of the running block by engaging the quadriceps and flexing the hip and knee of the leg while simultaneously resisting inferior movement of the running block with the arm or hand.

3. The method of claim 1 wherein:

the step of securing the fixed block in a fixed position comprises trapping a stirrup under the user's foot, said stirrup being secured to the fixed block.

* * * * *